US008210321B2

(12) United States Patent
Finschi et al.

(10) Patent No.: US 8,210,321 B2
(45) Date of Patent: Jul. 3, 2012

(54) SYSTEM AND METHOD FOR DETERMINING A DESTINATION STORY BASED ON MOVEMENT DIRECTION OF A PERSON ON AN ACCESS STORY

(75) Inventors: Lukas Finschi, Lucerne (CH); Paul Friedli, Remetschwil (CH)

(73) Assignee: Inventio AG, Hergiswil (CH)

( * ) Notice: Subject to any disclaimer, the term of this patent is extended or adjusted under 35 U.S.C. 154(b) by 471 days.

(21) Appl. No.: 11/792,213

(22) PCT Filed: Nov. 28, 2005

(86) PCT No.: PCT/CH2005/000706

§ 371 (c)(1),
(2), (4) Date: Jun. 21, 2007

(87) PCT Pub. No.: WO2006/058446

PCT Pub. Date: Jun. 8, 2006

(65) Prior Publication Data

US 2008/0169159 A1 Jul. 17, 2008

(30) Foreign Application Priority Data

Dec. 1, 2004 (EP) ..... 04106222
Aug. 12, 2005 (EP) ..... 05107466

(51) Int. Cl.
*B66B 1/20* (2006.01)

(52) U.S. Cl. ..... 187/388; 187/392

(58) Field of Classification Search ..... 187/391–399, 187/380–388

See application file for complete search history.

(56) References Cited

U.S. PATENT DOCUMENTS

| | | | | | |
|---|---|---|---|---|---|
| 3,385,402 | A | * | 5/1968 | Burgy et al. | 187/385 |
| 4,149,614 | A | * | 4/1979 | Mandel et al. | 187/397 |
| 4,662,479 | A | * | 5/1987 | Tsuji et al. | 187/392 |
| 4,691,808 | A | | 9/1987 | Nowak et al. | |
| 4,836,336 | A | | 6/1989 | Schroder | |
| 4,895,223 | A | | 1/1990 | Ekholm et al. | |
| 5,086,883 | A | | 2/1992 | Schroder | |
| 5,092,430 | A | | 3/1992 | Goto et al. | |
| 5,382,761 | A | | 1/1995 | Amano | |
| 5,490,580 | A | * | 2/1996 | Powell et al. | 187/281 |
| 5,644,110 | A | | 7/1997 | Bahjat et al. | |
| 5,689,094 | A | * | 11/1997 | Friedli et al. | 187/384 |
| 5,719,360 | A | | 2/1998 | Davis et al. | |
| 5,786,550 | A | * | 7/1998 | Thangavelu | 187/386 |
| 5,841,084 | A | * | 11/1998 | Thangavelu | 187/382 |

(Continued)

FOREIGN PATENT DOCUMENTS

EP 1418147 A1 5/2004

(Continued)

*Primary Examiner* — Jonathan Salata

(57) ABSTRACT

A method and system for transporting people in a building using an elevator installation having at least one elevator cage determines a destination story based on the movement direction of people on an access story. The movement direction of one or more persons on an access story is detected using a movement direction sensor. The destination story may be based on detected movement and the access story on which the movement is detected. The elevator cage is entered by people on at least one first access floor (S1, S2). In order to increase the transport efficiency at least one target floor (S3, S4, S5, S6, S7) is associated with the access floor (S1, S2) in a fixed manner, in such a way that the elevator cage (11) travels from the first access floor (S1, S2) to the target floor (S3, S4, S5, S6, S7) associated therewith.

10 Claims, 4 Drawing Sheets

U.S. PATENT DOCUMENTS

| | | | | |
|---|---|---|---|---|
| 5,861,587 | A | 1/1999 | Powell et al. | |
| 5,984,051 | A * | 11/1999 | Morgan et al. | 187/392 |
| 6,065,570 | A | 5/2000 | Friedli et al. | |
| 6,109,396 | A * | 8/2000 | Sirag et al. | 187/381 |
| 6,202,799 | B1 * | 3/2001 | Drop | 187/388 |
| 6,209,685 | B1 * | 4/2001 | Zaharia et al. | 187/392 |
| 6,315,083 | B1 * | 11/2001 | Schuster et al. | 187/391 |
| 6,382,363 | B1 * | 5/2002 | Friedli | 187/384 |
| 6,397,976 | B1 * | 6/2002 | Hale et al. | 187/392 |
| 6,425,460 | B2 * | 7/2002 | Schuster | 187/247 |
| 6,801,792 | B1 * | 10/2004 | Schuster et al. | 455/566 |
| 6,978,863 | B2 | 12/2005 | Hikita | |
| 7,108,106 | B2 | 9/2006 | Kostka | |
| 7,165,655 | B2 * | 1/2007 | Cook et al. | 187/316 |
| 7,319,968 | B2 * | 1/2008 | Friedli et al. | 705/1 |
| 7,353,915 | B2 * | 4/2008 | Zaharia et al. | 187/388 |
| 7,377,364 | B2 * | 5/2008 | Tyni et al. | 187/380 |
| 7,581,622 | B2 * | 9/2009 | Amano | 187/384 |
| 7,650,966 | B2 | 1/2010 | Sansevero et al. | |
| 7,841,450 | B2 | 11/2010 | Smith et al. | |
| 8,020,672 | B2 * | 9/2011 | Lin et al. | 187/392 |
| 2007/0272495 | A1 * | 11/2007 | Makela et al. | 187/380 |
| 2008/0128219 | A1 | 6/2008 | Finschi et al. | |
| 2009/0294221 | A1 * | 12/2009 | Bahjat et al. | 187/396 |

FOREIGN PATENT DOCUMENTS

| | | |
|---|---|---|
| GB | 2313453 | 11/1997 |
| JP | 507337 | 3/1975 |
| JP | 03166177 | 7/1991 |
| JP | 11222372 | 8/1999 |
| JP | 2004250191 | 9/2004 |

* cited by examiner

SYSTEM AND METHOD FOR DETERMINING A DESTINATION STORY BASED ON MOVEMENT DIRECTION OF A PERSON ON AN ACCESS STORY

This is a U.S. national stage of application No. PCT/CH2005/000706, filed on Nov. 28, 2005. Priority is claimed on that application and on the following application:

Country: Europe, Application No. EP 04106222.5 Filed: Dec. 1, 2004; and

Country: Europe, Application No. EP 05107466.4 Filed: Aug. 12, 2005

BACKGROUND OF THE INVENTION

The invention relates to a method of transporting persons in a building by means of an elevator installation, which comprises at least one elevator cage, wherein the elevator cage is entered by persons at least one first access story. The invention further relates to an arrangement for transporting persons in a building with an elevator installation, which comprises at least one elevator cage, wherein at least one access story is provided.

Elevator installations are used for transportation of persons in publicly used buildings. The passengers in railway stations, airports and shopping centres are usually accompanied by bulky luggage or shopping trolleys. Due to the high loading of elevator installations complicated elevator control programs are used in order to increase the effectiveness in the transportation of persons. For example, a destination call control is used by way of which a passenger inputs his or her travel destination by means of an input device. An elevator control then allocates an elevator cage to the corresponding person on the basis of the desired destination story. It is thus achieved that persons having common destination stories are concentrated in an elevator cage, so that the travel time of the elevator cage is not prolonged by numerous intermediate stops.

A control device for controlling an elevator installation with a multiple cage is known from EP 1 418 147 A1. The multiple cage has several cage decks which are simultaneously accessible at a main stopping point by way of different main stopping levels. Two stories of a building can be served at the same time by the multiple cage with one stop. A call registration device by means of which a passenger can input his or her desired destination story is provided at the main stopping point. In order to enable a more rapid filling of the building and to minimise the number of intermediate stops of the multiple cage a computing unit is provided which is constructed for the purpose of determining on the basis of the destination call input of a passenger at the main stopping point and on the basis of already assigned and/or placed travel requests which cage deck of the multiple cage is assigned to the passenger at the main stopping point. The passenger is thus allocated, in correspondence with his or her destination call input, a level enabling effective transportation of persons by means of the multiple cage. After input of the destination call the passenger must then go to the appropriate level in order to enter the multiple cage at the corresponding level.

The assignment of persons to multiple cages by means of a destination call control and even assignment of persons to single elevator cages by means of destination call control requires a complex control. Notwithstanding this destination call control delays in the transportation of persons occur particularly at peak time, since, for example, persons who have not made a destination call board elevator cages.

SUMMARY OF THE INVENTION

Against this background the object of the present invention results as indicating a method and an arrangement for transporting persons in buildings in which the number of intermediate stops at stories of a building is minimised and shorter travel times are achievable.

The invention is based on the concept that at least one destination story is fixedly allocated to an access story, i.e. at least one elevator is provided at an access story and travels to a predetermined destination story. This fixedly predetermined destination story is not, as usual, established by a manual call input of a passenger, but is automatically established by the elevator control. The elevator control can determine the fixedly allocated destination story for a specific period or constantly in dependence on the structure of a building and on the occupancy, in terms of time, of the different stories. The fixedly predetermined destination story is preferably the most likely travel destination of a passenger per building part and at a certain time. By "fixedly allocated" there is meant, in particular, that the story is no longer changed after at least one person has entered the elevator cage.

For example, the fixedly allocated story can be, during the opening times for filling up a parking facility of a building, the floor where a shopping centre lies, since the persons in the parking facility at this time of day most probably want to go to the floor of the shopping centre.

In the case of conventional destination selection of controls passengers input their destination intentions explicitly at so-termed destination selector terminals by input of a destination floor. In addition, the destination intention can also be communicated implicitly by the presentation of an identification medium insofar as an automatic destination was filed in a data bank beforehand for the corresponding day. The present invention, thereagainst, consists in that the instantaneous destination is situationally known to the elevator control. If, for example, individuals move in a shopping centre from a parking floor in direction towards elevators there is a high probability that they want to reach the shopping floor. If they move in opposite sense, possibly with a full shopping trolley, from the shopping floor in direction towards elevators then they probably want to go back to the parking floor. Depending on the respective floor and movement direction the travel destination is predictable in both these cases and can thus be automatically triggered and signalled. In addition, in the case of several possible destinations, such as, for example, several parking floors, different elevators of a group can be conducted to these destinations. On the other hand, however, also several destinations can be allocated by the elevator control in advantageous predetermined manner in succession to one elevator.

The invention offers, inter alia, the following advantages:

Passenger flows can be controlled efficiently in such a manner, particularly in the case of strongly frequented elevator installations for passengers with luggage or shopping trolleys, that formation of a build-up by waiting or undecided passengers is largely avoided. In the case of large cages it is possible to further avoid the situation that passengers standing in the region of the door have to prematurely disembark and re-embark together with their luggage in order to make space for passengers standing further back and wanting to disembark. This is achieved in that in each instance only passengers for the same destination are located in the cage. The invention is advantageous particularly in publicly used buildings where passengers without knowledge of the location frequently visit or passengers who due to bulky luggage do not have a hand free for a selective call input.

Modern office buildings often have several access stories. If several access stories are present, by way of which the building is opened up, the performance capability of the elevator installation can be increased if at least one destination story is fixedly allocated to the destination stories. In the case of the refinement in accordance with the invention the elevator cage travels from a first access story to at least one fixedly allocated destination story. According to the invention persons can thereby be so guided to the elevator that they are transported from an access story to the allocated destination story without an intermediate stop. Through the assignment of persons to the respective correct elevator, persons with the same destination story enter the same elevator cage. From there the elevator cage travels directly to the appropriate destination story.

By contrast to the assignment, which is known from the state of the art, of elevator cages by means of destination call control there is carried out here an assignment of persons to elevator cages with fixed destination stories.

It is thus ensured that, for example, the customers of a shopping centre travelling to the same destination story always enter the same elevator cage at the access story and travel from there to their destination story. Customers of another company accommodated in another story use, for example, a different elevator cage which travels to the destination story at which the other company has its offices. Transportation in the elevator cages takes place without intermediate stops at the stories.

In a simple embodiment the invention can be constructed with a elevator cage which travels from a first access story to a fixedly allocated destination story at, in particular, appropriate times. Thus, persons with the same destination stories can be guided to the same elevator cages, whereby travel times of the elevator cages are substantially reduced.

An efficient conveying of persons can thereby be made possible particularly at rush hours. Flows of persons can be guided by the method according to the invention, wherein also several elevators are effectively utilised. There is avoidance of the situation that all persons who would like to be transported in this building wait at an access story for a single elevator cage and have to be assigned to the elevator cages in dependence on the destination call inputs. In addition, there is avoidance of the situation that customers not only of a shopping centre, but also of a second company board the same elevator cages at the access story and travel from there to their destination stories. In this case the elevator cage would have to stop not only at the access story, but also at first and second destination stories. Particularly when two elevator cages are provided for transportation, it is more effective to allow one elevator cage to travel from the access story directly to the first destination story and the second elevator cage to travel from the access story to the second destination story. The sole precondition for effective transportation is in this connection that the persons board the correct elevator cages at the access stories.

In a special embodiment of the invention it is possible that a first group of destination stories for a elevator cage is fixedly allocated to an access story. A reduction in the possible intermediate stops is thus achieved, whereby the travel time is minimised.

Indicating devices can be used to illustrate the fixed allocation of destination stories to the respective elevators. Persons who would like a first facility can read off the respective elevator and move towards it without the destination story having to be actively input by the passenger. This is advantageous particularly when the allocation of the destination stories to the elevators is variable, so that the users have to reorientate with regard to which elevator cage travels to their destination story. In the case of non-variable allocation of destination stories to the elevators the assignment or guidance of persons to the elevators can be carried out by a permanent inscription in the building.

The flows of persons can be efficiently co-ordinated by the method according to the invention so that, for example, persons who want to go to the uppermost floor in the shopping centre are recognised by an access terminal on entry into the building and then assigned to a elevator from which a elevator cage travels directly to the story in which the shopping centre is located. Other destination stories cannot be reached by visitors of the shopping centre without manual destination input.

The access terminal preferably has sensors such as, for example, optical, acoustic, infrared, radar, movement or video sensors, which can recognise persons approaching the elevators.

Features of the passengers, such as being accompanied by shopping trolleys or sports bags, are preferably recognised by the sensor so as to be able to propose an appropriate destination story.

The method according to the invention can be used particularly efficiently if the elevator installation has several elevator cages, wherein a first elevator cage serves a first destination story and the second elevator cage serves a second destination story. If beyond that still further elevator cages are arranged in the elevator installation for the transportation of persons it is possible that several elevator cages travel from an access story fixedly to a destination story or that an additional elevator cage for the transportation of persons to other destination stories, for which no fixed allocation is present, is provided.

In a preferred refinement of the invention the destination stories are fixedly allocated to the access stories only at specific times. The fixed allocation of destination stories to the elevators offers itself particularly at peak times in order to efficiently cover the increased need for transport. Between the peak times, all destination stories in the building can be reached by the elevator cages.

Specific destination stories may advantageously be allocated only when the facilities located there, such as businesses, restaurants, leisure facilities, means-of-transport, etc., are open or ready for operation.

The fixed allocation of destination stories to access stories is in certain circumstances undertaken in time-dependent manner.

In the case of an arrangement in accordance with the invention for transport of persons in a building with an elevator installation the elevator installation comprises at least one elevator cage, wherein at least one access story is provided and at least one destination story is fixedly allocated to the access story.

In an advantageous embodiment it is provided that a building control unit undertakes the assignment or guidance of persons to elevators in accordance with the destination stories thereof, wherein the building control unit is advantageously coupled with access terminals. The access terminals can be constructed as a part of the building control unit. The access terminals recognise a passenger. An elevator call is actuated from this recognition directly in the access terminal or in the building control unit and an elevator cage is indicated to the person.

Moreover, an indicating device for indication of allocation of the destination stories to the access stories is preferably provided. The indicating device can be constructed in the form of a display in order to indicate a variable allocation of elevators to destination stories. The indicating device can, however, also be constructed as a simple information panel in the case of a fixed allocation.

In the elevator cage itself advantageously the next destination or destinations is or are indicated and announced so that the passengers also receive confirmation of the destination story without active destination input.

Beyond that the system is advantageously learning-capable and automatically offers, by virtue of the use habits of passengers at specific times of day, the respectively sought destination stories.

Moreover, input terminals advantageously also allow selective input of a destination story if this should not be offered at the desired point in time. It is possible to use the fixed allocation of destination stories to the elevators in combination with a destination call control.

BRIEF DESCRIPTION OF THE DRAWINGS

The invention is explained in the following in more detail on the basis of examples of embodiment which are illustrated in schematic manner in the drawings, in which.

DETAILED DESCRIPTION OF THE INVENTION

Figure 1:
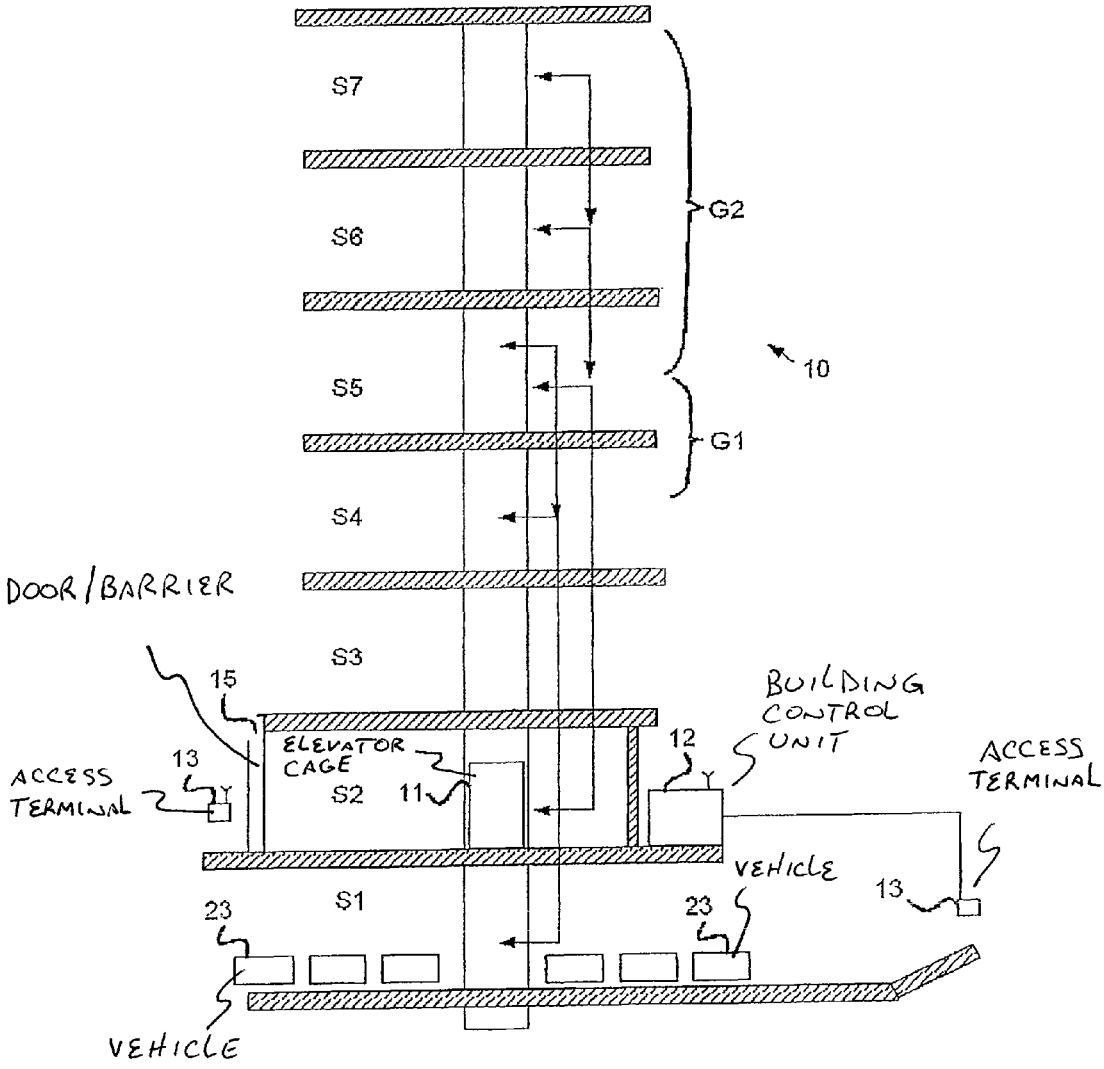
FIG. 1 shows a schematic illustration of an elevator installation according to the present invention.

A schematic illustration of a building with an elevator installation 10 and with seven stories is shown in FIG. 1. Of those, the stories S1 and S2 are constructed as access stories and stories S4 to S7 as destination stories. An elevator cage 11 is moved in the elevator installation 10 in order to transport persons from the respective access stories S1 and S2 to a destination story S4, S5, S6 or S7. The access story S1 is an underground garage to to which vehicles 23 of the persons go and where the persons are recognised by an access terminal 13. Persons who board the elevator cage 11 in the underground garage or the access story S1 are transported either to the destination story S4 or to the destination story S5. Persons who enter the elevator cage 11 at the access story S2 are transported to the destination story S5, S6 or S7. The two access terminals 13 are coupled with a building control unit 12 either wirelessly via the indicated aerials or by way of a connecting line. A first group G1 of destination stories, which comprises the destination stories S4 and S5, can be reached from the first access story S1. A group G2 with the destination stories S5, S6 and S7 is allocated to the second access story S2. The destination stories S4 and S5 are fixedly allocated to the access story S1. The destination stories S5, S6 and S7 are fixedly allocated to the access story S2.

Figure 2:
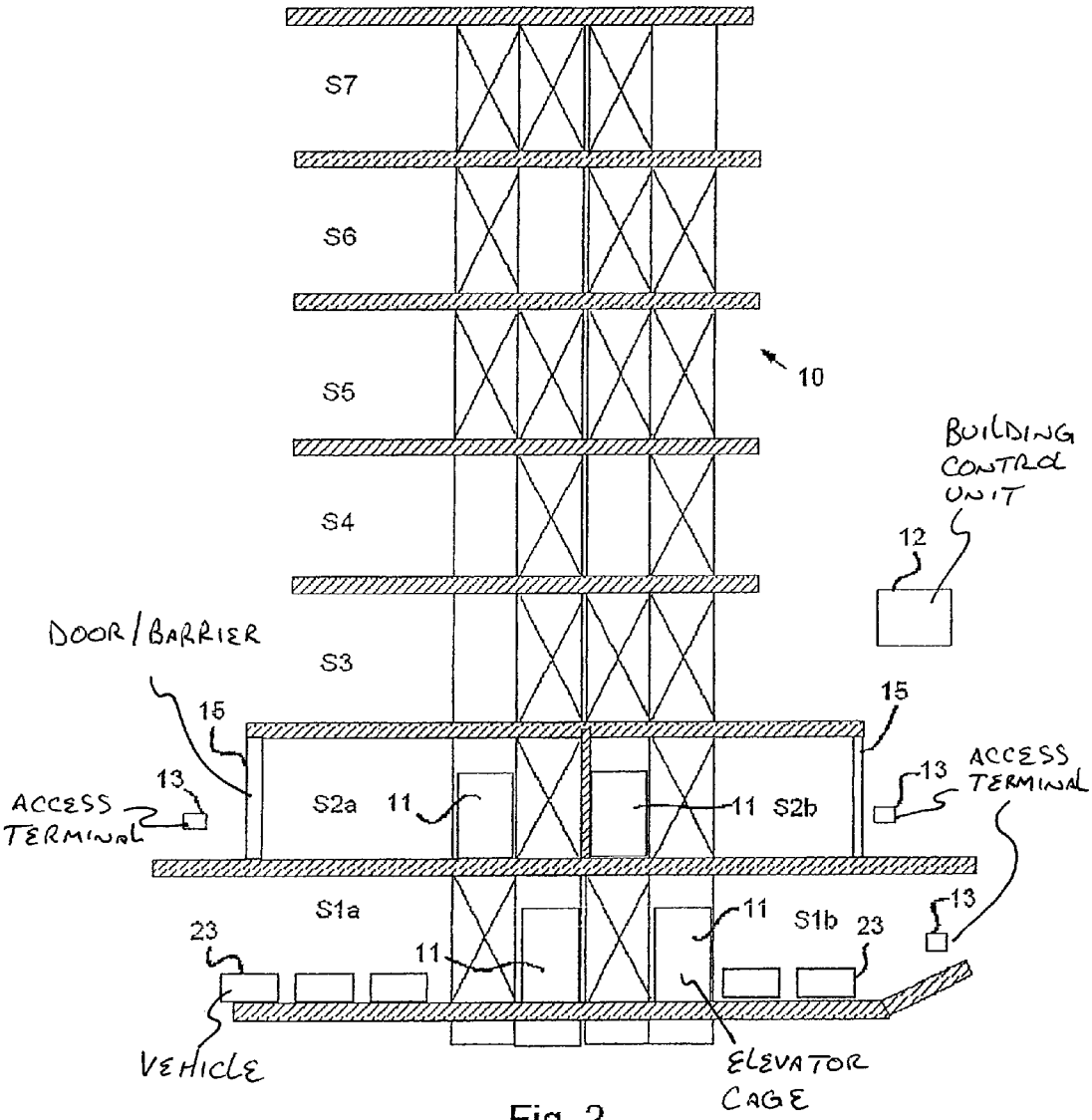
FIG. 2 shows a schematic illustration of an alternative elevator control according to the present invention.

An alternative embodiment of an elevator installation 10 for use of the method according to the invention is illustrated in FIG. 2. The elevator installation 10 according to FIG. 2 has four elevator cages 11 which are arranged for transportation of persons. The elevator installation 10 comprises four separate access stories S1*a*, S1*b*, S2*a* and S2*b*. Persons who enter the elevator cage 11 at the access story S1*a* are transported to the destination story S6. Persons who enter the elevator cage 11 at the access story S1*b* are transported to the destination story S7. Persons who enter the elevator cage 11 at the second access story S2*a* are transported to the destination stories S3 and S4. Thereagainst, persons who enter the elevator cage 11 on the other side of the second access story S2*b* are transported only to the destination story S4. The respective access stories S1*a*, S1*b*, S2*a* and S2*b* are opened by way of doors or barriers 15 in each instance after recognition at an access terminal 13. Destination stories S4, S5, S6 and S7, which cannot be traveled to by individual cages 11, are provided with a large "X". There are also destination stories S4 which are accessible by way of other elevator installations (not illustrated) or only by way of stairs. Destination stories S5 of that kind are, for example, reachable only by a manual elevator cage control, for example in the case of use as a store or a safety area without appreciable traffic of persons.

Figure 3:
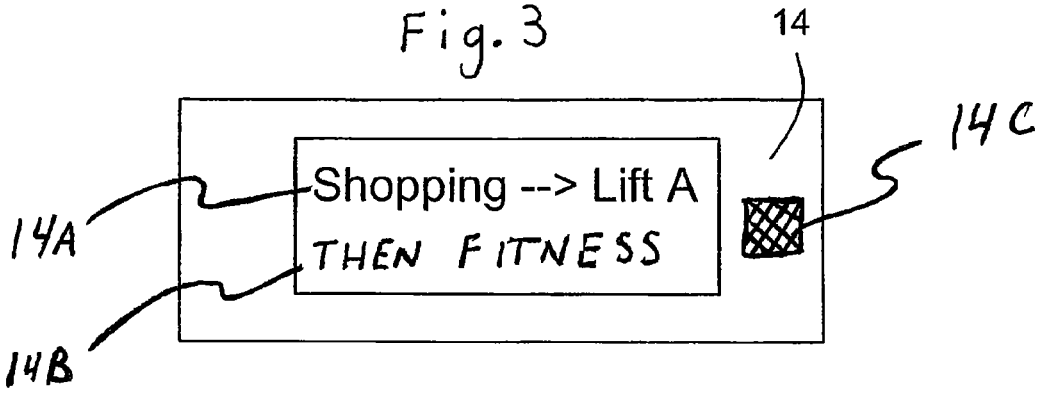
FIG. 3 shows a schematic illustration for guidance of persons and an indication of destination stories, according to the present invention.
Figure 4:
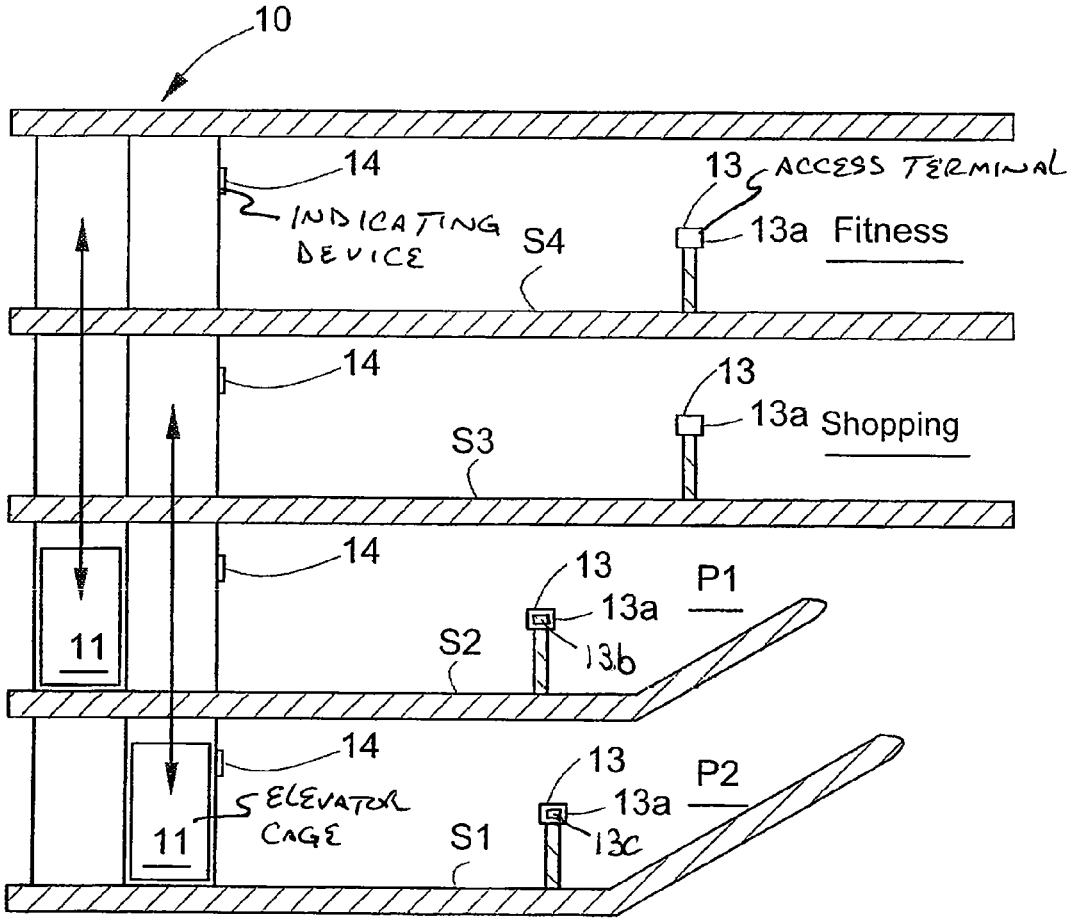
FIG. 4 shows a schematic illustration of a elevator installation and the guidance of persons, according to one embodiment of the present invention.

The co-ordination, which is required for effective utilisation of the elevator installation 10 according to FIGS. 1 and 2, of the flows of visitors or persons in a building is illustrated in FIGS. 3 and 4.

On entering a building a passenger is initially recognised by an access terminal 13. The allocation of the destination stories is indicated on an indicating device 14 which is shown in FIG. 3 displaying a next travel destination 14A, a destination after next 14B and includes an acoustic indicator 14C for providing an indication acoustically. The users of the facility A (shopping centre) are automatically guided to the first elevator A. Users of the facility B (fitness) have to actuate an elevator call. By way of the automatic guidance to the elevator A the elevator cage A is automatically assigned to the shopping centre users, by which they go to the fixedly allocated destination story S3. If in the meantime a passenger should be recognised as a customer of the fitness centre, then another or second indication appears, for example, with the reference 'Fitness→Elevator B'.

It is possible through the refinement according to the invention that the elevator cage 11 in each instance has to serve only a small number of different travel destinations, whereby a higher performance capability and a higher travel convenience of the elevator installation 10 are achieved.

The idea according to the invention can also be transferred in analogous manner to other applications. In the case of restaurants which extend over several stories the respective restaurant visitors are already assigned, on driving into the parking garage, parking spaces for their vehicles 23 and elevators which correspond with their desired destination restaurant. It is further possible to reach theatres or cinemas in each instance by way of an access story in which the parking places correspond with the respectively allocated destination story from which the elevator cage automatically travels to a theatre or to a desired cinema. The corresponding elevator from which an elevator cage 11 travels directly to the fixedly allocated story with the cinema is indicated to the cinema visitor on an indicating device 14.

It is possible through the refinement of the method according to the invention and the arrangement for transporting persons to make possible rapid travel to a specific travel destination, wherein only a short waiting time and a short overall travel time to the destination are necessary.

FIG. 4 shows a schematic illustration of an elevator installation and the guidance of persons in accordance with a preferred embodiment of the present invention.

Movement detectors 13*a* detect the passengers already in the frontal region of the elevators in the elevator lobbies and automatically call an elevator cage 11. Illuminated displays 14 inform which elevator travels to which floor. The passengers are transported to the desired story S3, S4 without destination input and intermediate stop. Manual destination inputs are necessary only still in exceptional cases. This control is suitable particularly for buildings with an intensive traffic of public between a few stories.

Movement direction sensors 13*a* detecting the movement direction of passengers are to be mounted on those stories where the passenger flows are to be automatically assigned to the destinations and elevators. If the passengers move in the direction of the elevators, one or more destination calls are automatically triggered and optionally the corresponding elevators are listed on indicating boards. Radar sensors (e.g., radar sensor 13*b* of FIG. 4), video sensors (e.g., video sensor 13*c* of FIG. 4) or other sensors can be used as directional sensors, which can distinguish disembarking passengers from potentially boarding passengers.

The automatic destinations as well as the elevators assigned to the destinations are indicated on a display on the way to the elevators; for example:

Shopping→Elevator B

Fitness→Elevator A

LED moving text boards, TFT, plasma or CRT displays, projectors for the projection of information on a wall or on the floor, etc., are used as displays. An acoustic announcement is also conceivable. Such signposting displays make sense particularly when at the instant of directional detection of passengers the indications about the elevators cannot yet be viewed. In order to make the indication more conspicuous, the information can also be represented in flashing manner.

Display boards 14 are mounted above or near the elevator doors where the destinations served by the respective elevator are listed and, in particular, as long as the door is open.

During the opening time these indications typically begin to flash in order to finally extinguish shortly before door closure. The same display technologies can be used for these destination displays as for the signposting displays.

In a department store three panorama elevators 10 transport, for example, passengers between four stories: Parking-1 S2, Parking-2 S1, Shopping 0 S3 and Fitness Centre S4.

If a passenger wants to go from Parking-1 and -2 to the floor Shopping he or she is automatically transported to his or her destination. This also applies to the return route from Shopping to Parking. Movement detectors 13*a* in the elevator lobbies Parking-1 and -2 as well as Shopping can detect the passengers and immediately call an elevator cage 11. Illuminated displays 14 above the entry doors of the three panorama elevators show which elevator travels to which floor. The passenger directly and automatically reaches the floor Shopping S3 from Parking-1 and -2. In order to go back to the parking garage after shopping, an elevator 11 for Parking-1 and an elevator for Parking-2 is automatically provided for the passenger by the movement sensor 13*a*. The passenger can board the appropriate elevator without destination input and is automatically transported to the desired, fixedly allocated story. A speech announcement in the cage confirms to the passenger his or her desired destination. Disposed in the elevator cage itself are only still the door closing and opening buttons as well as the alarm button. Through this installation the passengers are already grouped in the elevator lobbies and thus benefit from direct journeys. In the case of large cages the elevator doors automatically close only after a fixed time period since entry of the first passenger has elapsed or when the cage is full. The cage thereafter travels to the destination story. Inconvenient boarding and disembarking with shopping trolleys between the individual stories and long waiting times are thus eliminated.

A manual destination input is only still necessary when passengers move between the two Parking stories-1 and -2 or want to go to the floor Fitness Centre S4. A manual destination can be input at the keyboard located between the three elevators. An elevator is assigned to the passenger on the display above the keyboard and then takes the passenger directly to his or her desired destination.

Figure 5:
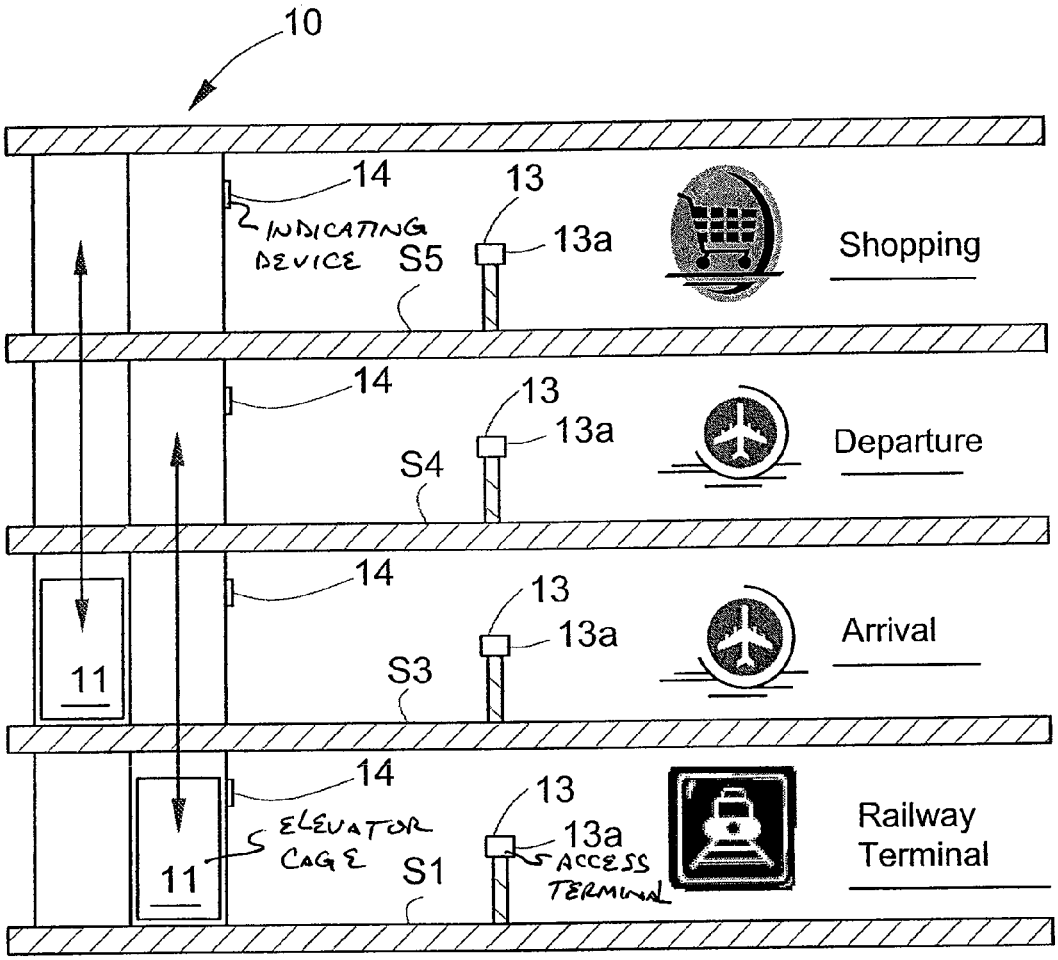
FIG. 5 shows a schematic illustration of an elevator installation and the guidance of persons, in accordance with a second embodiment of the present invention.

FIG. 5 shows a schematic illustration of an elevator installation and guidance of persons in accordance with a further preferred form of embodiment of the present invention. The floor 'Shopping' is optional.

Movement detectors 13*a* detect the passengers in an airport already in the frontal region of the elevators in the elevator lobbies and automatically call an elevator cage. Illuminated displays 14 inform which elevator travels to which floor. The passengers are transported to the desired story without destination input and intermediate stopping. Manual destination inputs are necessary only exceptionally.

In an airport three elevators 10 transport, for example, the passengers between four stories: Railway Terminal S1, Arrival S3, Departure S4 and Shopping S5.

If the passengers are going to Railway Terminal, a elevator cage for the story Departure and, in the case of need, a second elevator cage for the story Arrival are automatically fixedly allocated and the passenger is automatically transported to his or her destination. The floor Departure is the most likely travel destination of a passenger in this part of the building. This also applies to the return route from the story arrival A to the Railway Terminal. The persons wanting to go from Railway Terminal to Arrival are small by comparison and can also be expected to go by way of the Departure to the destination and disembark only at the second stopping point. Movement detectors 13*a* in the elevator lobbies Railway Terminal and Arrival can detect the passengers and immediately call an elevator cage 11. Illuminated displays 14 above the entry doors of the three elevators show which elevator travels to which destination. From the Railway Terminal the passenger directly reaches the floors S3 and S4 by way of the automatic elevator call. In order to go back to the Railway Terminal an elevator 11 is automatically provided at the story S3 or S4 for the passenger by the movement detector 13*a*. The passenger can board the appropriate elevator without destination input and is directly transported to the desired story. A speech announcement in the cage confirms to the passenger his or her desired destination. In the elevator cage itself there are disposed only still the door closing and/or opening buttons as well as the alarm call button. Through this installation the passengers are already grouped in the elevator lobbies and thus benefit from direct journeys. Tiresome boarding and disembarking with luggage between the individual stories and long waiting times are thus avoided.

A manual destination input is only necessary when passengers move between the two stories S3 and S4 or want to go to the optionally present floor Shopping S5. A manual destination can be input at the keyboard located between the three elevators. An elevator is allocated to the passenger on the display above the keyboard and again takes the passenger directly to his or her desired destination.

The destinations in the elevator can optionally be acoustically repeated again, for example:

While door is open:

"First Stop Departure" or

"This Elevator Serves Parking Level 2"

Before opening of the door:

"Disembark Here For Departure"

"Please Disembark For Parking Level 2".

In principle it is possible for a single passenger to trigger several calls (for example, Parking 1 and Parking 2 or even three calls). Although the invention was conceived simply to manage large passenger flows in public buildings, it can be disturbing in the case of a small traffic volume that then one of the elevators executes its journey empty. In order to prevent this, execution of the journey can be inhibited by means of an empty recognition and the elevator remains, after door closing, simply at a standstill. For empty recognition all present-day zero-load sensors can be used. Of particular interest at present are video volume sensors which reliably recognise an empty cage.

The method according to the invention can efficiently sort very large traffic flows according to destinations, assign transport means in optimal manner and lastingly improve transport performance in that the passengers (together with their pieces of luggage, shopping trolleys and luggage trolleys, etc.) are brought to their destinations in the most direct route. The method makes sense particularly when the destinations are clear from the situation and the number thereof is not too large (preferably at most 3).

For implementation of the invention the situations defining the automatic destinations must be clearly known. It is, however, readily possible for destinations, which are not automatically triggered, to be reachable from a specific story; these destinations must then be input at a terminal. It is merely important that the majority of passengers desire a destination from the elevator of automatic destinations. There are various kinds of automatic destinations:

Destination is fixed or destinations are fixed independently of the time of day or time of week.

Destinations are dependent on a time control; for example, the destination "Shopping" is from the Parking level during the opening time for filling up and the destination "Fitness Studio" is in the evening.

Destinations are learned the passengers input their destination at a terminal. If sufficiently same destinations are input, this destination is generated as an automatic destination until sufficient other destinations were input at the terminal, etc.

The invention claimed is:

1. A method of transporting one or more persons in a multi-story building with an elevator installation, the elevator installation comprising an elevator cage, the method comprising:

detecting, based on energy reflected by bodies of the one or more persons, a movement of the one or more persons on an access story toward the elevator installation;

providing access to the elevator cage to the one or more persons at the access story, the elevator cage being configured to serve two or more destination stories in the building; and transporting the elevator cage to a preset story of the destination stories without destination input from the one or more persons, the preset story being a default destination for travel from the access story.

2. The method according to claim 1, further comprising indicating the preset story in advance to the one or more persons by way of an indicating device.

3. The method according to claim 1, the detecting being performed using at least one sensor mounted on an access terminal.

4. The method according to claim 3, the at least one sensor comprising a radar sensor or a video sensor.

5. The method according to claim 1, the preset story being optically or acoustically indicated within the cage.

6. The method according to claim 1, further comprising closing doors of the elevator cage after a fixed time period from entry of the one or more persons into the cage or if the cage is full.

7. The method according to claim 1, the preset story being determined based in part on a time schedule.

8. An elevator installation, comprising:

at least one elevator cage that serves an access story and two destination stories in a building; and at least one movement sensor on the access story, the elevator installation being configured to:

provide access to the at least one elevator cage to a passenger detected by the at least one movement sensor on the access story, the passenger detected based on energy reflected by a body of the passenger; and transport the at least one elevator cage to a preset story of the destination stories without destination input from the passenger, the preset story being a default destination for travel from the access story.

9. The elevator installation according to claim 8, further comprising an indicating device for receiving an indication of a destination story from another passenger.

10. The method of claim 1, further comprising setting the preset story as the default destination for travel from the access story based on input destinations for a plurality of previous elevator passengers.

* * * * *